US008561671B2

(12) United States Patent
d'Hone

(10) Patent No.: US 8,561,671 B2
(45) Date of Patent: Oct. 22, 2013

(54) METHOD AND TWIN ROLL CASTER FOR THE PRODUCTION OF STRIP CAST FROM A MOLTEN METAL

(75) Inventor: André d'Hone, Krefeld (DE)

(73) Assignee: Outokumpu Nirosta GmbH, Krefeld (DE)

( * ) Notice: Subject to any disclaimer, the term of this patent is extended or adjusted under 35 U.S.C. 154(b) by 0 days.

(21) Appl. No.: 12/918,177

(22) PCT Filed: Feb. 20, 2009

(86) PCT No.: PCT/EP2009/052063

§ 371 (c)(1),
(2), (4) Date: Oct. 27, 2010

(87) PCT Pub. No.: WO2009/103801

PCT Pub. Date: Aug. 27, 2009

(65) Prior Publication Data

US 2011/0048668 A1 Mar. 3, 2011

(30) Foreign Application Priority Data

Feb. 22, 2008 (DE) ..... 10 2008 010 688

(51) Int. Cl.
*B22D 11/06* (2006.01)

(52) U.S. Cl.
USPC ..... 164/480; 164/428

(58) Field of Classification Search
USPC ..... 164/428, 480
See application file for complete search history.

(56) References Cited

U.S. PATENT DOCUMENTS

| | | | |
|---|---|---|---|
| 5,188,166 | A | 2/1993 | Perry |
| 6,296,046 | B1 | 10/2001 | Jeong et al. |
| 7,066,238 | B2 | 6/2006 | Hohenbichler et al. |

FOREIGN PATENT DOCUMENTS

| | | | |
|---|---|---|---|
| GB | 2 337 016 | A | * 11/1999 |
| JP | 3-174954 | A | 7/1991 |
| JP | 5-237603 | A | 9/1993 |
| JP | 2000-117397 | A | 4/2000 |
| WO | 2004/000487 | A1 | 12/2003 |

* cited by examiner

*Primary Examiner* — Kevin P Kerns
(74) *Attorney, Agent, or Firm* — The Webb Law Firm

(57) ABSTRACT

A twin roll caster and method for producing strip cast from a molten metal using the twin roll caster. The twin roll caster has casting rolls which delimit a casting gap between them on its longitudinal sides and narrow sides sealed in each case by a side plate which is moved during the casting operation about an axis of oscillation in an oscillating manner. The inventive method and the twin roll caster enable the risk of operational disruptions from molten mass solidifying in the region of the side plate to be further minimized. This is achieved by changing the position of the axis of oscillation during the casting operation.

14 Claims, 2 Drawing Sheets

METHOD AND TWIN ROLL CASTER FOR THE PRODUCTION OF STRIP CAST FROM A MOLTEN METAL

BACKGROUND OF THE INVENTION

When casting strip according to the twin roll casting process, the oppositely-rotating casting rolls of the caster delimit the longitudinal sides of the casting gap. On its narrow sides, however, the casting gap is sealed by a side plate in each case.

The side plates are usually comprised of an insert and a support plate, which bears the insert. The insert in this case is usually made from refractory material and is formed so that it partly covers the front sides, associated with it, of the casting rolls and completely covers the narrow side, to be delimited by it, of the casting gap.

The relative movements, necessary in the casting process, between the side plates and the front sides, of the casting rolls as well as the contact with the molten metal moving through the casting gap inevitably lead to wear of the side plate due to abrasive wear. This is particularly true if the contact between the side plates and the molten metal or the casting rolls is realised by means of an insert made from refractory material.

In order that, in the case of side plates equipped with such inserts, it is ensured that the side plates perfectly fulfil their sealing function also at the start of the casting process, it is necessary to grind in the inserts before the casting process begins. For this purpose the respective side plate is adjusted while the casting rolls are rotating until its inserts lie with the required contact pressure against the respective associated front sides of the casting rolls. Thereupon abrasive wear of the insert material occurs in the region of the contact surfaces.

This condition is maintained until the casting rolls are ground in to a certain required depth into the refractory material of the insert and the insert lies closely fitting against the front sides of the casting roll. The inserts of the side plates now have one section, the so-called "positive insert", projecting into the casting gap, and two sections, the so-called "insert grinding surfaces", adjacent thereto, springing back in relation to the positive insert, with which sections they lie against the front sides of the casting rolls. Here the positive insert with its lateral edge surface covers a narrow margin, adjacent to the respective casting roll front side, of the peripheral face of the casting rolls in each case.

Corresponding to the cross-sectional shape, determined by the casting roll form, of the casting gap, the width of the positive insert in the casting direction reduces continuously following the peripheral radius of the casting rolls, while the insert grinding surfaces are usually dimensioned so that their width remains uniform over the entire arc of contact with the casting rolls.

Because the side plates, possibly by means of their respective insert, are in direct frictional contact with the cooled casting rolls during the casting process, heat is constantly removed from them. Therefore, during the casting process, the temperature of the side plates is usually lower than the temperature of the molten mass coming into contact with them. Consequently heat is also removed from the molten mass when it touches the side plates. The heat loss in this case can be so great that molten mass solidifies on the respective positive insert. In the case of side plates equipped with an insert made from refractory material, this heat dissipation takes place particularly in the region of the positive insert.

Such solidifications, in technical parlance also known as "parasitic solidifications", form in practice particularly in the lower third, seen in the casting direction, of the tapering part of the positive insert. Furthermore parasitic solidifications can also form in the region of the so-called triple points at which the respective side plate insert, the respective casting roll and the bath surface of the molten metal flowing through the casting gap converge. The places where the solidifications form are usually equally distributed on both side plates.

Whether parasitic solidifications actually form depends on various factors. Thus the quality of the molten mass that is to be cast (melting range, solidification enthalpy, nucleating agents etc.) is paramount in determining the tendency to form parasitic solidifications. The formation of parasitic solidifications is also affected by the free space available above the bath surface level of the casting gap up to the cover of the casting gap and the vertical lowering means and mould levels contingent thereon.

Moreover the temperature distribution in the side plates or their inserts has substantial influence on the formation of parasitic solidifications. This depends firstly on the axial and vertical speeds, at which the side plate is moved. Secondly the temperature distribution depends on the material of the insert and the currents which can arise near the inserts and are determined by the distance of the immersion nozzle, through which the molten mass is fed into the casting gap, from the insert as well as the kinetic energy of the molten mass entering the casting gap.

Parasitic solidifications can cause strip defects, such as thickness discontinuities (deviation from defined tolerances), insufficient through-solidification (bulging aspects) and material tears (strip edges). In extreme cases they may require the casting process to be aborted.

A further manifestation of the wear on the inserts of the side plates results as a consequence of strip shells forming on the cooled casting rolls during the strip casting process. Increased material wear occurs due to the relatively high strength of these strip shells along the casting roll arc of contact. This material wear leads to the formation of a gap between the particular casting roll and the insert associated with it, whose width (growth and swarming of the strip shell) and depth (erosion=casting material strength and/or corrosion=casting material analytics) increase starting from the level of the molten mass cast into the casting gap towards the narrowest roll distance.

At the corresponding size, the gap formed in the insert by the removal of material promotes the formation of so-called "T-edges", which are flanked by molten mass, so that the insert and the respective solidifying strip shell can become positively clamped together. As a consequence of the contraction, accompanying the solidification of the molten mass, of the strip width, tensions can then occur in the strip, which tensions become so great that the strip tears in the longitudinal direction. Such longitudinal tearing may also require the casting to be aborted.

It is known that wear of the insert due to contact with solidifying molten mass can be reduced by moving the insert during the casting process in a precisely pre-determined way, relative to the molten mass that is being cast. For this purpose the side plates are oscillated rotationally about a centrally arranged axis. With this rotational oscillation it is equally possible to counteract solidifications in the lower third of the insert and to counteract the wear increasing downwards. Examples of this procedure are described in Japanese Patents JP 03-174954, JP 05-237603 or U.S. Pat. No. 5,188,166.

Common to the known possibilities of minimising wear by oscillation, however, is the disadvantage that in the case of rotational oscillation the fulcrum of the oscillation cannot be shifted or, in the case of horizontal oscillation of this movement, no rotational movement can be superimposed. A shift of the fulcrum may, however, then be necessary in the case of rotational oscillation, for example if the level of the surface of the bath is varied. Likewise a shift of the fulcrum may be necessary in the horizontal direction if higher-strength or more chemically aggressive materials, materials with different solidification behaviour, materials with varying viscosities and not least different casting thicknesses are to be produced.

A further disadvantage of the rotation about a certain central axis, used in the state of the art described above, is that lowering of the inserts is only possible to a limited extent, since here the fulcrum is shifted in or against the casting direction. Such lowering however is expressly recommended for example in WO 04/000487 (EP 1 515 813 B1) for minimising wear or in U.S. Pat. No. 6,296,046 for aligning the insert lower edge with the so-called "kissing point", at which the strip shells solidified on the peripheral faces of the casting rolls are pressed against one another.

In order to ensure mobility of the side plates proposed in each case, so-called "supporting structures" are employed in practice. These usually comprise a support frame. This supports the adjustment devices needed for adjusting the position of the side plate in the way proposed in each case. Here the support frame can be held in guides, in which it is adjustably mounted in a horizontal and/or vertical direction and can be supported in relation to the firm substrate, on which the particular caster stands (WO 04/000487).

SUMMARY OF THE INVENTION

Against the background of the state of the art described above, the object of the invention was to indicate a method and create a twin roll caster, with which the risk of operational disruptions through molten mass solidifying in the region of the side plate is further minimized.

The invention is based on the finding that it is advantageous for minimising wear of the respective side plate in a way which surpasses the state of the art, if the side plate is not only moved about a certain axis of oscillation in an oscillating manner, but furthermore the position of the axis of oscillation of the side plates is also changed. Practical investigations have shown that the risk of parasitic solidification of the molten mass is also effectively counteracted in this way.

The successes achieved by the invention have proven to be particularly effective when the side plate supports an insert made from a refractory material, which during the casting operation in the way known from the state of the art lies against the casting rolls and comes into contact with the molten mass.

The position of the axis of oscillation of the side plates can be changed according to the invention during the casting operation as a function of different process parameters. For this purpose movement cycles, which are pre-calculated or determined empirically in a manner optimised for wear can be stored in a suitable control unit, and are then followed during the casting operation under consideration of the casting progress.

The invention is thus based on the general concept of changing the fulcrum of the oscillation of the side plate during the operation. For this purpose all suitable actuators can be used, which on the one hand are capable of carrying out the oscillation of the side plate about the respective axis of oscillation and on the other hand are capable of performing an adjustment of the position of the axis of oscillation which is carried out in addition to the rotational oscillation movement of the side plate.

Accordingly one or, if required, also a plurality of adjustment devices can be provided, whose adjustment movements are superimposed over the oscillating movement of the side plate, so that the adjustment movement carried out by the adjustment devices concerned leads to a shift of the axis of oscillation of the side plate. By way of example for this purpose a first adjustment device can take over the adjustment in the horizontal or vertical direction, while a second adjustment device takes over movement of the side plate in the respective other direction, that is to say in the vertical or horizontal direction, if this is shown to be expedient.

It is also conceivable to use the adjustment devices provided in each case to superimpose a further oscillating movement over the first oscillating movement of the side plate, in principle provided for adjusting the position of the axis of oscillation of this oscillating movement. Dependent on the conditions existing in practice, for this purpose it can for example be advantageous if the inventive adjustment taking place transversely to the axes of rotation of the casting rolls is carried out in the vertical and/or horizontal direction, moving step-wise back and forth, that is to say oscillating, between two end points. Dependent in each case on the choice of oscillation mechanics, the fulcrum can be moved in a horizontal plane through different amplitudes while ascending or descending on the left or right reversal point of the pendulum movement. Now not only a line characteristic of the movement but a two-dimensional adjustment field arises as a result.

An inventive twin roll caster, just as the type-defining state of the art, has two casting rolls, which delimit a casting gap between them on its longitudinal sides. The inventive caster in this case, just as the state of the art, is equipped with two side plates delimiting the casting gap on its narrow sides.

The side plates in this case, typically on their side associated with the casting gap, support an insert made from a refractory material, lying against the front sides, associated with it, of the casting rolls and extending over the casting gap. However the invention can in principle also be used for side plates, which do not possess such an insert but wherein the contact face between the molten mass or casting rolls and the side plate is formed in another way.

Likewise, in accordance with the state of the art, in the case of one inventive caster, furthermore at least one oscillation device is also provided, which is associated with one of the side plates and moves the side plate during the casting operation about an axis of oscillation in an oscillating manner.

Adhering to the basic idea of the invention already described and in a way surpassing the state of the art, in the case of an inventive twin roll caster at least one additional adjustment device is provided for moving the side plate in a direction aligned transversely to the axes of rotation of the casting rolls.

For the reasons already stated in connection with the inventive method it may be expedient in this case if the adjustment device moves the side plate in the vertical and/or horizontal direction.

The changes of the position of the axis of oscillation of the side plates in the vertical and horizontal direction in this case can naturally be combined so that they result in a movement, by which the position of the axis of oscillation is shifted in a movement diagonally aligned in space. For this purpose two adjustment devices can for example also be provided, of which the one moves the side plate in the vertical direction and the other moves the side plate in the horizontal direction.

The inventive shift of the position of the side plate taking place in addition to the oscillation can be implemented in practice in that the side plate is coupled to the oscillation device by means of the adjustment device for shifting the axis of oscillation in the direction aligned transversely to the axes of rotation of the casting rolls. This configuration permits a particularly space-saving, light-weight embodiment of an inventive machine.

Alternatively or additionally, the oscillation device can be carried by an adjustment device, which is provided to adjust the oscillation device and with it the side plate moved by it in the respective direction aligned transversely to the axes of rotation of the casting rolls. This embodiment is characterised by particular robustness, which suits the hard operating conditions to which an inventive caster is exposed in practice.

Because an adjustment device is arranged both between the side plate and the oscillation device and also because the oscillation device is carried by an adjustment device, combined adjustment can be implemented in the vertical and horizontal direction.

If the side sealing structure is mechanically separated in such a way that the oscillator can be moved vertically and a support plate, for example connected thereto by means of a linear guide, for an insert can likewise be moved vertically against the oscillator, then the fulcrum of both kinds of oscillation can be shifted in a vertical line, while the vertical insert position stays the same.

The inventive adjustment in the direction taking place transversely to the axes of rotation is also enabled by virtue of the fact that the respective adjustment device comprises a force generator acting on the side plate or the oscillation device, which force generator delivers adjusting forces that are aligned axially parallel with the axes of rotation of the casting rolls and a reversal device, which returns the forces delivered by the force generator in a direction aligned transversely to the axes of rotation of the casting rolls. The reversal device can, for example, concern a wedge, which is shifted in the axial direction of the casting rolls and at the same time, by means of its wedge surfaces, moves the oscillation device or the side plate in the particular desired direction aligned transversely to its sliding direction. In this way the inventive adjustment can be carried out in a particularly simple and space-saving manner.

The invention is described below in more detail on the basis of a drawing illustrating exemplary embodiments, wherein there are shown schematically in each case:

DESCRIPTION OF THE PREFERRED EMBODIMENTS

Figure 1:
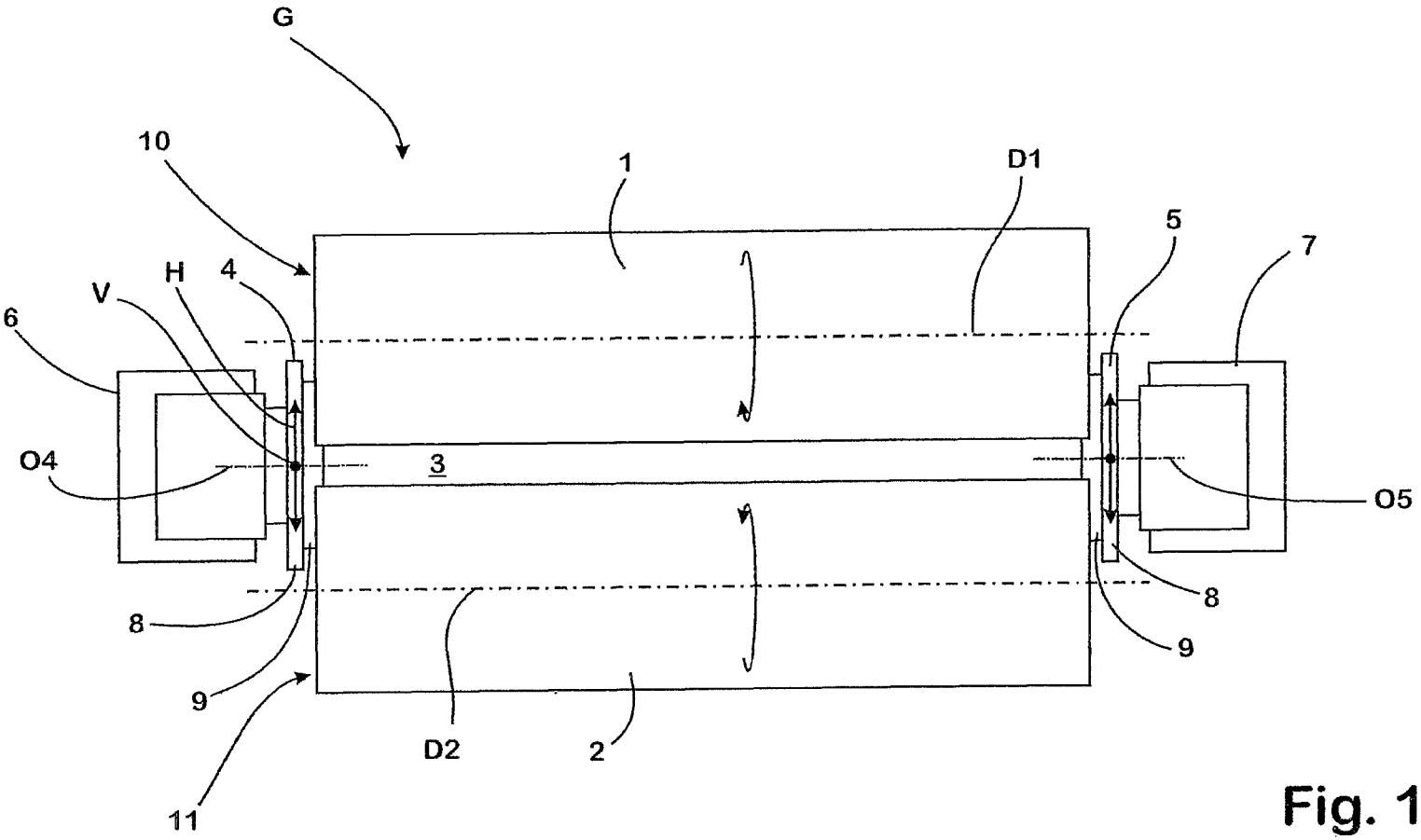
FIG. 1 is the twin roll caster of the present invention viewed from above.

The twin roll caster G has two casting rolls 1, 2, which each rotate in the opposite direction about a horizontally aligned axis of rotation D1, D2. The casting rolls 1, 2 delimit a casting gap 3 between them on its longitudinal sides.

On its narrow sides the casting gap 3 is sealed by a side plate 4, 5 in each case, which is respectively supported by an adjustment device. The adjustment devices each comprise a supporting structure 6, 7. The supporting structures 6, 7 each bear an oscillation device, which oscillates the side plate 4, 5 associated with it in each case, in the casting operation about an axis of oscillation O4, O5 in each case.

The side plates 4, 5 each comprise a steel support plate 8, which on its side associated with the casting gap 3 bears an insert 9 made from a refractory material. The shape of the insert 9 is selected in such a way that it superimposes the front sides 10, 11, associated with it, of the casting rolls 1, 2 in each case in an insert grinding surface 12, 13 in the form of the arc of a circle.

The insert grinding surfaces 12, 13 have been ground in into the insert 9 over the course of a start-up process of the twin roll caster G carried out according to specific instructions after the respective side plate 4, 5 has been newly fitted with a new insert 9, by abrasive removal of material. They delimit between them a positive insert 14, freely projecting opposite them into the casting gap, which insert with its arc-shaped side surfaces 15*a*, 15*b* lies closely against the peripheral surface of the casting roll 1, 2 associated with the respective side surface 15*a*, 15*b*.

The supporting structures 6 or 7, associated with the side plates 4 or 5, are each formed identically.

Figure 2:
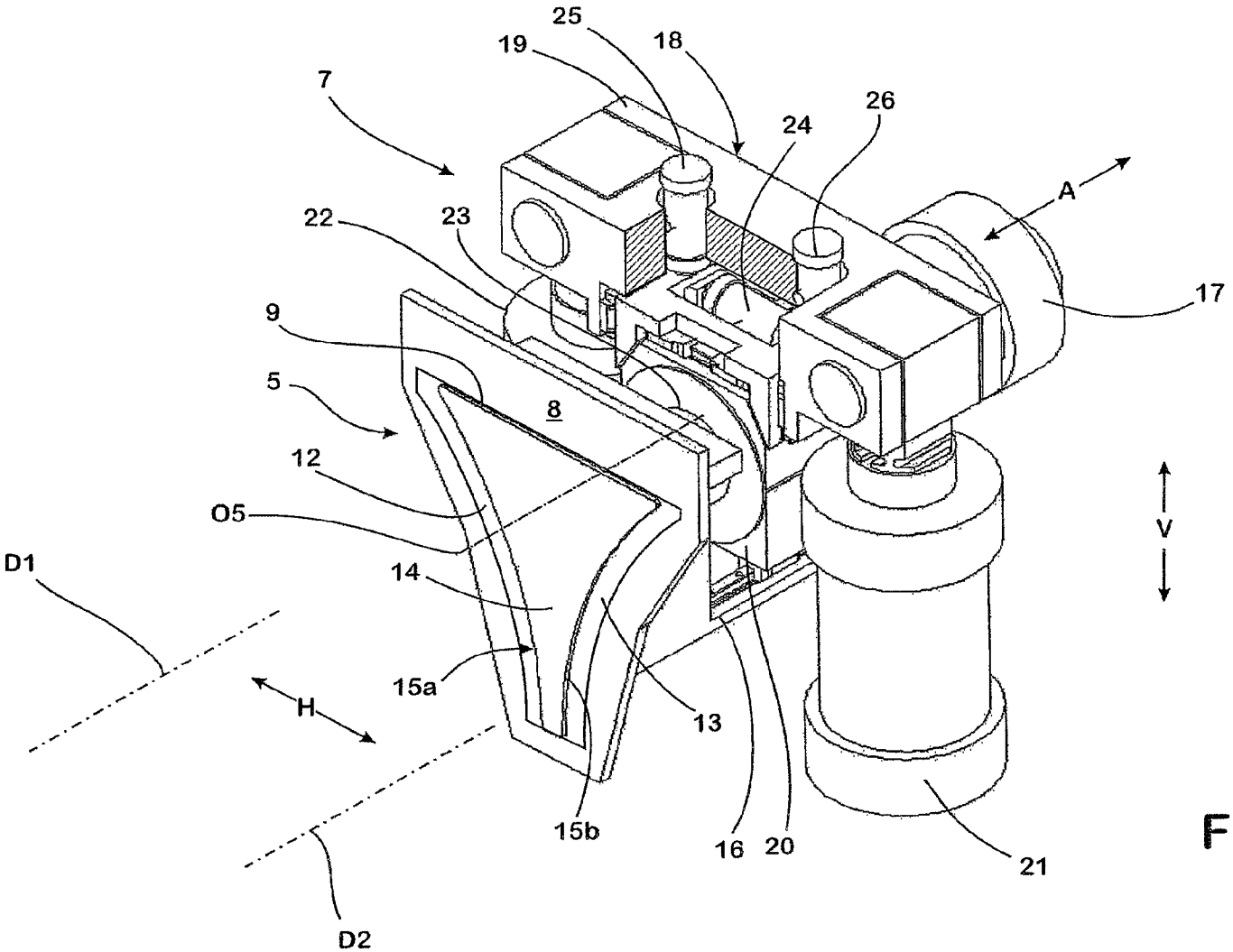
FIG. 2 is a perspective view of an adjustment device for a side plate used in the twin roll caster illustrated in FIG. 1.

As illustrated in FIG. 2 based on a possible embodiment of the adjustment device associated with the side plate 5, the supporting structure 7 in the case of this embodiment is displaceably mounted on a guide 16 in axial direction A of the axes of rotation D1, D2. An axial positioning cylinder 17 serving as axial actuator is provided for adjustment in axial direction A. During the casting process this holds the respective side plate 5 with its insert under a certain pre-determined pressure in contact with the respective front sides 10, 11 of the casting rolls 1, 2.

The axial positioning cylinder 17 in this case acts on a T-shaped support frame 18, which bears the side plate 5. The support frame 18 has an upper crosspiece 19 and a middle casing section 20 suspended thereon.

In each case a further hydraulically-operable adjusting cylinder 21, 22 is articulately coupled to the free ends of the crosspiece 19. The adjusting cylinders 21, 22, operable independently from one another, have a casing and a piston which is movable in the vertical direction, the piston shaft, guided out of the casing, of the piston being connected with its free end in each case by a joint to the end section associated with it. Observed from above, the one adjusting cylinder 21 here is arranged on the one side and the other adjusting cylinder 22 on the other side of the axis of oscillation O5.

The adjusting cylinders 21, 22 in each case are supported hydrostatically in order to be able to absorb the transverse forces possibly occurring during the adjustment, produced by the axial positioning cylinder 17, of the respective side plate 4, 5, in axial direction A, the transverse forces being directed into the casting gap 3, for example.

The adjusting cylinders 21, 22 form actuators, with the aid of which the respective side plate 4, 5 may be moved about its respective axis of oscillation O4, O5 in an oscillating manner. For this purpose the adjusting cylinders 21, 22 perform upwardly and downwardly aligned movements, for example each opposite to one another in the vertical direction V. Likewise for example the adjusting cylinder 21 can be arrested with its piston in a certain downward position, while the second adjusting cylinder 22 carries out further adjustment movements. The axis of oscillation O5 is thereby shifted to the axis of the joint, in which joint the adjusting cylinder 21 is articulately coupled to the crosspiece 19. Moreover the adjusting cylinders 21, 22 can at the same time or sequentially perform a lowering movement aligned in the same direction, in order to lower the position of the axis of oscillation O5 in the vertical direction V.

The adjusting cylinders 21, 22 move as a function of control signals of a control device, not shown here, which are connected to the adjusting cylinders 21, 22 by means of corresponding control lines and valve devices. According to the control signals transmitted over the control lines, the valves of the valve devices open or close, in order to retract or extend the pistons of the adjusting cylinders 21, 22 and accordingly swivel the side plate 5 via the crosspiece 19 into the one or other direction about the axis of oscillation O5.

The adjusting cylinders 21, 22 in this way together form actuators, which together with the control device associated with them and the valve device additionally provided where necessary as part of an oscillation device, move the side plate 5 in an oscillating manner.

The side plate 5 is coupled by means of a coupling device 23 to the front side, facing the casting rolls 1, 2, of the casing section 20. The coupling device 23 comprises a joint, not illustrated here, by means of which the axial positioning cylinder 17, serving as axial actuator, acts on the rear of the side plate 5. The joint is provided to compensate for an angular offset between the normal plane relative to the effective direction of force applied by the axial actuator onto the respective side plate and the normal plane relative to the axes of rotation of the casting rolls. Since the joint proposed according to the invention is able to compensate for an offset between the alignment of the force applied by the axial actuator 17 and the axes of rotation D1, D2 of the casting rolls, it is ensured that the respective side plate 5 always lies with an as far as possible homogeneous force distribution closely against the front sides 10, 11, associated with it, of the casting rolls 1, 2.

The joint thus permits tolerances, arising due to wear, structural inaccuracies and heat influences, in the distribution of the axial forces applied onto the respective side plate 4, 5 by the axial positioning cylinder 17 to be compensated. By means of the joint arranged according to the invention between the side plate 5, in each case to be subjected to the axial force, and the axial positioning cylinder 17 associated with it, it is namely achieved that the side plate 5, with its surface, associated with the casting rolls 1, 2, of the insert 9, also then always lies as far as possible uniformly against the casting roll front sides 10, 11, whenever locally different wear of the side plate 5 occurs as a consequence of material-related or process-related irregularities.

The casing section 20 of the support frame 8 is fastened to the crosspiece 19 by means of a sliding guide, not visible here in detail. In the sliding guide the casing section may be moved in a horizontal direction H, aligned transversely to the axes of rotation D1, D2, relative to the crosspiece 19 and therefore also transversely to the guide 16 and the axes of rotation D1, D2 of the casting rolls 1, 2 by means of an adjusting cylinder 24, serving as actuator for this direction of movement.

The sliding guide itself is suspended by means of two adjusting cylinders 25, 26 on the crosspiece 19 of the support frame 18. The adjusting cylinders 25, 26, likewise independently operable, together form an actuator, with which the casing section 20 and with it the respective side plate 5 can also again be moved in the vertical direction V relative to the crosspiece 19, in order to additionally superimpose a movement aligned in the vertical direction V onto the oscillating movement of the side plate 5. Observed from above here the one adjusting cylinder 25 is arranged on the one side and the other adjusting cylinder 26 on the other side of the axis of oscillation O5. In this way it is not only possible to adjust the side plate 5 by coordinated operation of the adjusting cylinders 25, 26 in a uniform movement in the direction V but, during asynchronous, alternating operation of the adjusting cylinders 25, 26, to adjust the side plate 5 in the direction V step by step in a see-saw movement.

REFERENCE SYMBOLS

1, 2 casting rolls
3 casting gap
4, 5 side plates
6, 7 supporting structure
8 support plate
9 insert
10, 11 front sides of the casting rolls 1, 2
12, 13 insert grinding surfaces
14 positive insert
15*a*, 15*b* side surfaces
16 guide
17 axial positioning cylinder
18 T-shaped support frame
19 upper crosspiece of the support frame 18
20 middle casing section
21, 22 adjusting cylinders
23 coupling device
24 adjusting cylinder for adjustment towards direction H
25, 26 adjusting cylinder for adjustment towards direction V
A axial direction of the axes of rotation D1, D2
D1, D2 axes of rotation of the casting rolls
G twin roll caster
H horizontal direction of movement
O4, O5 axis of oscillation of the side plates 4, 5
V vertical direction of movement

The invention claimed is:

1. A method for producing strip cast from a molten metal using a twin roll caster having casting rolls which delimit a casting gap between them on its longitudinal sides and narrow sides sealed in each case by a side plate, comprising rotating the side plates during a casting operation about an axis of oscillation in a rotational oscillating manner, the axis of oscillation extending substantially axially parallel to the axes of rotation of the casting rolls, wherein the position of the axis of oscillation is changed during the casting operation.

2. The method according to claim 1, wherein the change in position of the axis of oscillation takes place in the vertical direction.

3. The method according to claim 1, wherein the change in position of the axis of oscillation takes place in the horizontal direction.

4. The method according to claim 1, wherein the change in position of the axis of oscillation takes place in the horizontal direction and the vertical direction.

5. The method according to claim 1, wherein to shift the axis of oscillation a further oscillating movement is superimposed over the oscillating movement of the side plates.

6. The method according to claim 1, wherein the respective side plate, on its side associated with the casting gap, supports an insert made from a refractory material lying against front sides, associated with it, of the casting rolls and extending over the casting gap.

7. A twin roll caster comprising:

two casting rolls, that delimit a casting gap between them on its longitudinal sides;

two side plates that delimit the casting gap on its narrow sides; and at least one oscillation device, which is associated with at least one of the side plates and rotates the side plate during a casting operation about an axis of oscillation in a rotational oscillating manner, the axis of oscillation extending substantially axially parallel to the axes of rotation of the casting rolls, wherein at least one additional adjustment device is provided to move the side plate in a direction aligned transversely to the axes of rotation of the casting rolls.

8. The twin roll caster according to claim 7, wherein the adjustment device moves the side plate in the vertical direction.

9. The twin roll caster according to claim 7, wherein the adjustment device moves the side plate in the horizontal direction.

10. The twin roll caster according to claim 7, wherein at least two adjustment devices are provided, by which the one adjustment device moves the side plate in the vertical direction and the other moves the side plate in the horizontal direction.

11. The twin roll caster according to claim 7, wherein the oscillation device is coupled to the side plate by the adjustment device, which is intended to adjust the side plate in a direction aligned transversely to the axes of rotation of the casting rolls.

12. The twin roll caster according to claim 7, wherein the side plate is coupled to the oscillation device by the adjustment device for shifting the axis of oscillation in a direction transverse to the axes of rotation of the casting rolls.

13. The twin roll caster according to claim 7, wherein the respective adjustment device comprises:

a force generator acting on the side plate or the oscillation device and delivering adjusting forces that are aligned axially parallel with the axes of rotation of the casting rolls; and a reversal device, which returns the forces delivered by the force generator device in a direction aligned transversely to the axes of rotation of the casting rolls.

14. The twin roll caster according to claim 7, wherein the side plates each have a support plate, which on its side associated with the casting gap supports an insert made from a refractory material lying against front sides, associated with it, of the casting rolls and extending over the casting gap.

* * * * *